United States Patent [19]

Mattei et al.

[11] Patent Number: 4,733,673

[45] Date of Patent: Mar. 29, 1988

[54] METHOD AND DEVICE FOR FEEDING STRIP PAPER ON A DUAL-ROD CIGARETTE MANUFACTURING MACHINE

[75] Inventors: Riccardo Mattei; Bruno Belvederi, both of Bologna, Italy

[73] Assignee: G.D. Societa' per Azioni, Bologna, Italy

[21] Appl. No.: 827,519

[22] Filed: Feb. 10, 1986

[30] Foreign Application Priority Data

Feb. 26, 1985 [IT] Italy ..... 3348 A/85

[51] Int. Cl.[4] ..... A24C 5/14; A24C 5/18; A24C 5/20

[52] U.S. Cl. ..... 131/84.1

[58] Field of Search ..... 131/84.1, 84.2, 84.3, 131/84.4

[56] References Cited

U.S. PATENT DOCUMENTS 4,336,812 6/1982 Seragnoli ..... 131/84.1
4,418,705 12/1985 Seragnoli ..... 131/84.1
4,459,998 7/1984 Cabbe et al. ..... 131/84.1
4,463,766 8/1984 Arthur et al. ..... 131/84.1

*Primary Examiner*—V. Millin
*Attorney, Agent, or Firm*—Marshall, O'Toole, Gerstein, Murray & Bicknell

[57] ABSTRACT

Method and device for feeding strip paper on a dual-rod cigarette manufacturing machine, whereby two identical strips are first stabilized as to tension by respective adjustable brake means, and then fed by a common feed device onto respective conveyors extending along respective fixtures for forming respective cigarette rods; a first of the conveyors being set in such a manner as to feed the respective strip at a given theoretical speed, the common feed device being controlled in such a manner as to supply the amount of strip actually required by the first conveyor, and the other conveyor being controlled in such a manner as to supply the full amount of strip received from the common feed device.

8 Claims, 2 Drawing Figures

METHOD AND DEVICE FOR FEEDING STRIP PAPER ON A DUAL-ROD CIGARETTE MANUFACTURING MACHINE

BACKGROUND OF THE INVENTION

The present invention relates to a method of feeding strip paper on a dual-rod cigarette manufacturing machine.

On dual-rod cigarette manufacturing machines, cigarettes are usually produced by cutting crosswise and simultaneously two continuous cigarette rods formed by feeding respective paper strips through a filling station where a continuous layer of shredded tobacco is fed onto each strip.

Each strip and respective layer of tobacco is then fed through a forming fixture along which the opposite side edges of the strip are gradually folded together about the tobacco layer and then glued together to form a continuous cigarette rod, which, together with the other rod, is then cut into lengths by a single rotary cutting fixture operating at adjustable constant speed.

The said strips are usually fed through the machine by means of a feed device comprising a reel-off assembly for feeding a paper strip, twice as wide as the aforementioned strips, off a reel. The speed at which the said strip is reeled off is timed to the operating speed of the said cutting fixture in such a manner as to produce cigarettes at least theoretically of a given length.

The said feeding device also comprises a cutting unit for cutting the said strip longitudinally into the said two strips, each of which is usually run onto a respective conveyor extending along the said forming fixture and designed to feed the said strip along the same. Each strip and respective conveyor only mate in the presence of the said layer of tobacco which, when fed onto the said paper strip, provides for mechanically mating, by friction, the conveyor and respective paper strip. The friction coefficient between the conveyor and paper strip depends on a number of factors, such as the thickness, consistency and humidity of the tobacco layer, the humidity, elasticity and porosity of the strip, etc. Consequently, differing fluctuation in the respective said friction coefficients of the said two strips results in two problems: firstly, the length of the cigarettes coming off the machine is not always the same for both continuous cigarette rods; and secondly, only by chance does the actual cigarette length correspond with the theoretical length set by adjusting the speed of the reel-off assembly in relation to the operating speed of the cutting fixture.

On know types of dual-rod cigarette manufacturing machines, attempts have been made to solve both the aforementioned problems simultaneously by continuously controlling the operating speeds of the said conveyors in such a manner that, for each operation of the said cutting fixture, the length of the cigarettes produced is both the same for both rods and equal to a given reference length. As on-line detection of the respective lengths of the cigarettes produced from both rods poses serious difficulties, a proposal has been made to control the respective speeds of the said two conveyors as a function of a more readily detectable parameter varying in direct proportion to the length of the cigarettes produced.

Tests have shown, however, that, whenever the actual length of the cigarettes coming off the macine is greater or less than the set theoretical length, the tension of the respective paper strip between the respective conveyor and the said reel-off assembly is respectively greater or lower than the correct tension setting. One proposal already put forward for overcoming this drawback is to continuously detect the tension of each strip upstream from the respective conveyor and to employ signals, proportional to the difference between detected tension and a given reference tension value, for adjusting conveyor speed in such a manner as to eliminate the difference in tension and so produce cigarettes of the required set length.

Experiments conducted on the aforementioned system, however, can have revealed a number of serious drawbacks, mainly due to the tension of each strip fluctuating continually in relation to the given reference value. Such fluctuation, apparently caused by fluctuation in the friction coefficient between each strip and the respective conveyor, results in crosswise instability of the strips, each of which thus slips from side to side along the forming fixture and in relation to glueing devices on the said fixture for glueing together the opposite side edges of the strip. Instead of being straight, the respective bands along which the said pairs of opposite side edges are glued are therefore crooked and the resulting continuous cigarette rods of poor quality.

SUMMARY OF THE INVENTION

To overcome the aforementioned drawback, the present invention relates to a method of feeding strip paper on dual-rod cigarette manufacturing machines, the said method differing totally from the known method described above.

With this aim in view, the present invention relates to a method of feeding strip paper on a dual-rod cigarette manufacturing machine, the said rods being formed by feeding, via respective conveying means, a first and a second paper strip along a respective forming fixture designed to fold each said strip crosswise about a respective layer of tobacco, the said strips being produced by cutting longitudinally in half a strip of paper twice as wide as the said strips, characterised by the fact that it comprises stages consisting in:

regulating a first of the said conveying means in such a manner as to feed the respective said first strip at a given theoretical speed;

feeding the said strips to the respective conveying means by means of a feed device common to both strips;

controlling, via respective adjustable brake means, the tension of each of the said two strips extending between the said common feed device and the respective said conveying means, in such a manner as to maintain the tension of both said strips constantly equal to a given tension value;

controlling the said common feed device in such a manner as to feed both the said strips at the same speed at which the said first strips is actually fed by the said first conveying means;

controlling a second of the said conveying means in such a manner as to feed the respective said second strip at the same speed at which the said second strip is fed by the said common feed device.

The above method is based on the results of numerous tests conducted on dual-rod cigarette manufacturing machines with no on-line adjustment of the respective speeds of the conveyors along the respective forming fixtures. Testing has shown that, once the respective speeds of the conveyors have been set, it takes a relatively long time for the difference between the set length and the length of the cigarettes obtained from each rod to exceed the normal tolerances applied, whereas even the slightest difference in length between matching cigarettes on both rods soon results in an unacceptable difference in strip consumption, and possibly also in tearing of the strip.

Working, therefore, on the practical assumption that, once set, conveyor speed remains, for a relatively long period of time, within an acceptable initial setting range, the method in accordance with the present invention no longer provides for regulating conveyor speed according to strip tension, i.e. by increasing or reducing speed in response to a fall or increase respectively in strip tension, but simply for maintaining the tension of both strips absolutely constant by means of adjustable brake means. As a result, the entire system is rendered perfectly stable, and setting the speed of either of the two conveyors, which thus acts as a lead conveyor the speed of which is maintained substantially equal to the initial setting over a relatively long period of time, enables cigarettes of substantially the required length to be obtained from the respective continuous cigarette rod.

Therefore, by measuring the amount of strip supplied by the lead conveyor, the speed of the feed device common to both strips may be regulated in such a manner as to supply, for both strips, the amount of strip required by the said lead conveyor.

Finally, by comparing the respective strip lengths supplied by the said lead conveyor and the said second conveyor, the speed of the second conveyor may be regulated in such a manner as to keep both lengths the same.

By virtue of the aforementioned system, it is therefore possible to produce, from both continuous cigarette rods, matching pairs of cigarettes, the respective lengths of which will be undoubtedly equal and will comply for a relatively long period of time with a given set length. The present invention also relates to a device for feeding strip paper on a dual-rod cigarette manufacturing machine, the said device comprising two fixtures for simultaneously forming two continuous cigarette rods, a common feed device for supplying an identical first and second paper strip to the said fixtures for respectively forming a said first and a said second continuous cigarette rod, and first and second conveying means extending along the said forming fixtures and designed to feed the said first and the said second rod respectively along the same; characterized by the fact that it also comprises first and second tension stabilizing means and first and second compensating means cooperating respectively with the said first and the said second strip; each said stabilizing means comprising means for detecting the tension of the respective said strip, and braking means engaged in sliding manner by the said strip and the variable power of which is controlled by the respective said detecting means in such a manner as to maintain the said tension constantly equal to a given set tension; the said compensating means comprising first and second counterweight means, supported respectively on the said first and second strip, and first and second means for respectively detecting the position of the said first and second counterweight means; the said first position detecting means controlling the said common feed device in such a manner as to maintain the said first counterweight means in a given position, and the said second position detecting means controlling the said second conveying means in such a manner as to maintain the said second counterweight means in a given position.

BRIEF DESCRIPTION OF THE DRAWINGS

A non-limiting arrangement of the present invention will now be described with reference to the accompanying drawings in which.

DETAILED DESCRIPTION OF THE INVENTION

Figure 1:
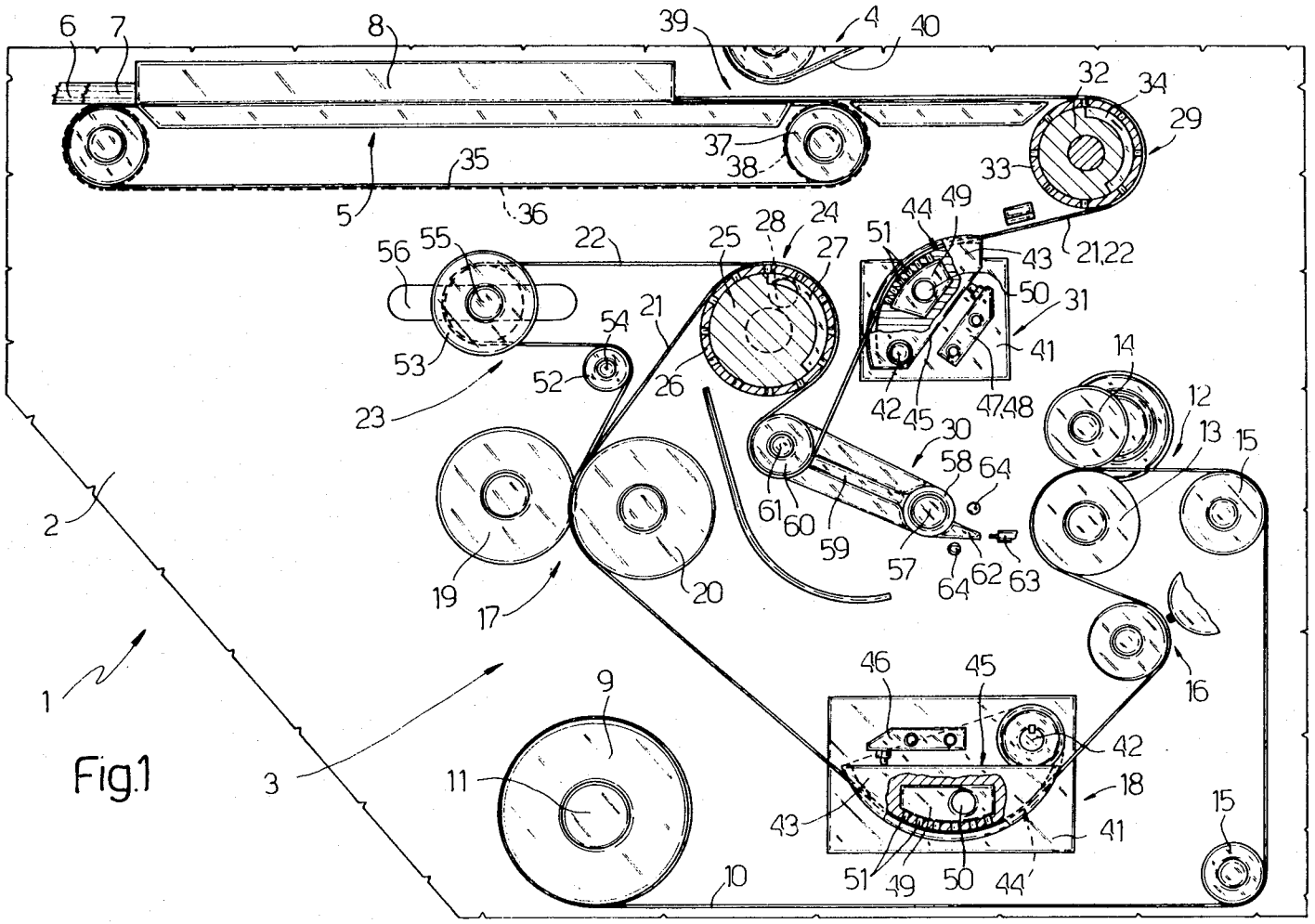
FIG. 1 shows a partial, schematic view of a dual-rod cigarette manufacturing machine fitted with a paper strip feed device in accordance with the present invention.

Number 1 in FIG. 1 indicates a dual-rod cigarette manufacturing machine comprising a frame 2 supporting a paper feed device 3, a tobacco feed device 4 and a top table 5 for forming two continuous cigarette rods 6 and 7. The said rods 6 and 7 are formed inside respective forming fixtures 8 (only one of which is shown in FIG. 1) arranged side by side on table 5, after which, they are sent to a cutting station (not shown) where they are cut simultaneously into given lengths by a single known type of rotary cutting fixture (not shown).

Paper feed device 3 comprises a reel 9 for supplying a paper strip 10. The said reel 9 is mounted in rotary manner on a substantially horizontal shaft 11, supported on frame 2, and is unwound by a reel-off assembly 12 comprising a drive roller 13 and a pressure roller 14, both supported on frame 2 with their respective axes parallel with that of reel 9 and between which strip 10 is fed by means of a number of transmission rollers 15.

Paper feed device 3 also comprises a printing unit 16 into which strip 10 is fed, as it comes out of reel-off assembly 12, and which is designed to print on the said strip 10 a double series of graphics (not shown) arranged on opposite sides of the longitudinal axis of strip 10 and usually comprising the brand name of the cigarettes being produced.

As it comes off printing unit 16, strip 10 travels through paper feed device 3 to a cutting device 7 via a tension stabilizing device 18.

Cutting device 17 comprises a cutting roller 19 and a counter-roller 20, both supported on frame 2 and turning about respective axes parallel with that of reel 9, and is designed to cut strip 10 longitudinally into two identical strips 21 and 22.

As they come off cutting device 17, the said strips 21 and 22 are fed, the first directly and the second via a timing device 23, to a feed device 24 comprising a roller 25 parallel with reel 9 and supported in fixed manner by frame 2; the said roller 25, in turn, supporting a pierced rotary jacket 26 a portion of which communicates with a suction circuit 28 via a chamber 27 formed on the outer edge of roller 25.

Strips 21 and 22 are supplied by feed device 24 to a second feed device 29 via respective compensating devices 30 and respective tension stabilizing devices 31 (only one of each is shown in FIG. 1). Feed device 29 is set up at the input of table 5 and, line feed device 24, comprises a fixed inner roller 32 supporting a pierced rotary jacket 33 a portion of which communicates with a suction circuit (not shown) via a chamber 34 formed on the edge of roller 32.

Feed device 29 feeds strips 21 and 22 onto respective top branches of respective conveyor belts 35 and 36 (shown by a continuous and dotted line respectively in FIG. 1) having respective drive rollers 37 and 38 and extending over the top of table 5 and through respective forming fixtures 8.

Conveyors 35 and 36 supply strips 21 and 22 to forming fixtures 8 and through a filling station 39 where tobacco feed device 4, via two suction type output conveyors 40 (only one shown in FIG. 1), feeds respective continuous layers of shredded tobacco (not shown) onto strips 21 and 22. Inside forming fixtures 8, the opposite side edges of each of strip 21 and 22 are folded together in known manner and glued together so as to enclose the respective continuous layer of tobacco and so form continuous cigarette rods 6 and 7.

As shown in FIG. 1, stabilizing device 18 and stabilizing devices 31 each comprise a supporting plate 41 connected to frame 2 and supporting, in rotary manner, a shaft 42 parallel with the axis of reel 9 and fitted with a brake means consisting of suction shoe 43. Shoes 43 present respective walls defined by respective curved lateral surfaces 44 arranged contacting strip 10 and strips 21 and 22 respectively, the respective flat lateral surfaces 45 opposite respective curved surfaces 44 and arranged contacting tension detecting means comprising respective moving rods on respective differential transducers numbered 46 on stabilizing device 18, and 47 and 48 on the two stabilizing devices 31. Each shoe 43 comprises an inner chamber 49 conntected to a respective suction source 50 and communicatiing with respective curved surface 44 via a number of holes 51.

As shown in FIG. 1, timing device 23 comprises two transmission rollers 52 and 53, the first mounted in rotary manner on an angle 54 supported in fixed manner on frame 2, and the second mounted in rotary manner on an axle 55 designed to move crosswise along a shot 56 formed on frame 2 for the purpose of adjusting the length of strip 22 extending between cutting device 17 and feed device 24, and so ensuring that the graphics (not shown) printed on either of strips 21 and 22 by printing unit 16 match perfectly with the graphics printed on the other strip.

As shown in FIG. 1, compensating devices 30 are mounted in rotary manner on a shaft 57 supported on frame 2 parallel with the axis of reel 9, and each comprise a hub 58 mounted in rotary manner on shaft 57, a lever 59 extending radially from hub 58, a counterweight 60 consisting of a roller mounted in rotary manner on a shaft 61 parallel with the axis of reel 9 and integral with the free end of lever 59, and an appendix 62 extending substantially radially from hub 58 and in diametrically opposed manner in relation to lever 59. Each compensating device 30 also comprises means for detecting the position of counterweight 60, the said means comprising a differential transducer 63 facing appendix 62 and designed to emit electric signals proportional, in value and sign, to the displacement of appendix 62 in relation to a zero position between two limit switches 64, each of the said limit switches 64, if reached by appendix 62, being designed to emit machine stop signals.

Figure 2:
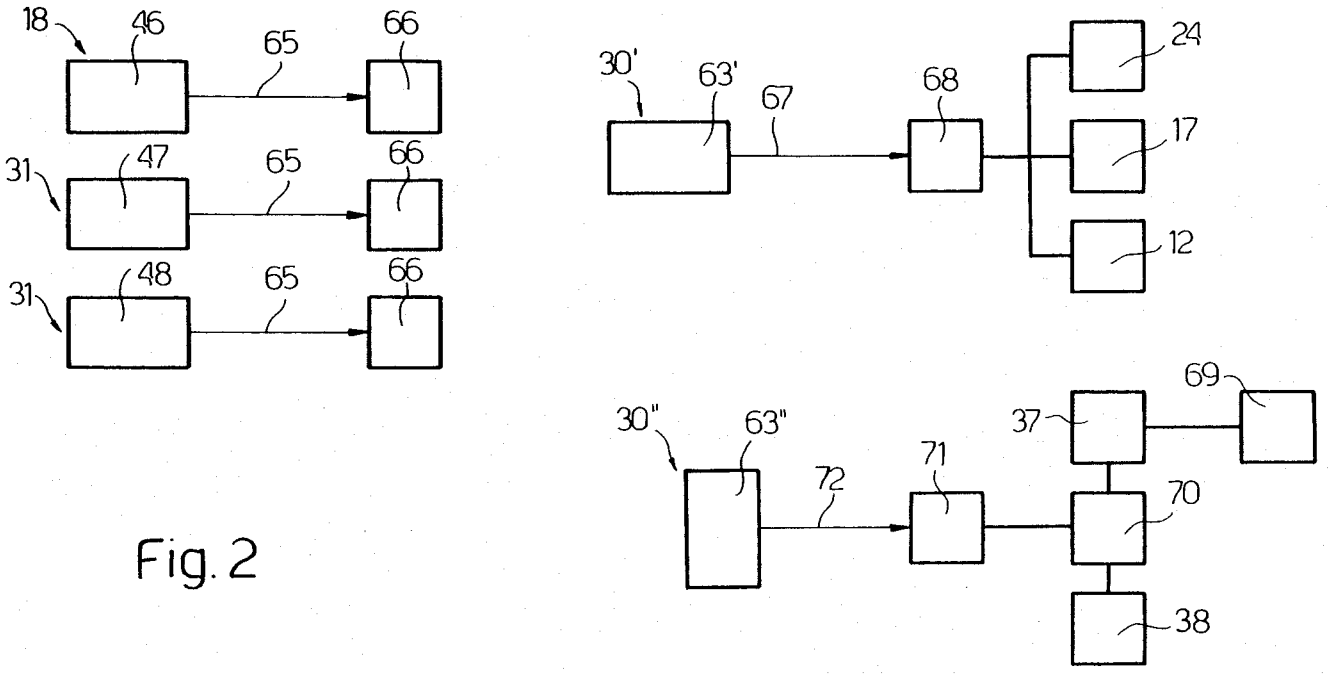
FIG. 2 shows an electric control diagram relative to the FIG. 1 feed device.

As shown in FIG. 2, stabilizing device 18 and each of stabiliziing device 31 comprise a circuit 65, via which, respective differential transducer 46, 47 or 48 controls a respective suction device 66 connected to respective suction source 50.

In actual operation, each shoe 43 is supported flexibly, by the moving rod on respective transducer 46, 47 and 48, against the thrust exerted respectively on shie 43 by strip 10 or by strip 21 or 22. Each of the said transducers 46, 47 and 48 is designed to detect the balance angle assumed by shoe 43 about the axis of respective shaft 42, to compare it with a given correct reference angle, and to emit an error signal. Via respective circuit 65, the said error signal controls the suction power of respective device 66 in such a manner as to cancel the said signal.

Each of transducers 46, 47 and 48 is regulated so that its zero setting corresponds with a given tension on strip 10 or on strip 21 or 22 extending over and contacting curved surface 44 on respective shoe 43. Consequently, even the slightest variation, as compared with the said given tension, in the tension of the paper extending between stabilizing device 18 and forming fixtures 8 results in a corresponding variation in the drag exerted by shoes 43 on strip 10 and strips 21 and 22, in such a manner as to bring the respective tension of strip 10 and strips 21 and 22 back to the required value.

In other words, during operation of machine 1, the respective tension of strip 10 and strips 21 and 22 is maintained substantially constant and equal to the said given tension value.

As shown in FIG. 2, differential transducer 63 (63' in FIG. 2) on compensating device 30 (30' in FIG. 2) associated with strip 21 controls, via circuit 67, a motor 68 powering feed device 24, cutting device 17 and reel-off assembly 12. In more detail, the slightest deviation of lever 59 on compensating device 30' from an adjustable zero setting on transducer 63' results in negative or positive acceleration of motor 68 for recovering the said deviation.

As shown in FIG. 2, drive roller 37 is powered by motor 69 and connected to roller 38 via a known type of differential assembly 70, the output of which may be plus or minus adjusted in relation to the input via a control member 71, usually a motor, controlled, via a control circuit 72, by transducer 63 (63" in FIG. 2) on compensating device 30 (30" in FIG. 2) associated with strip 22. In more detail, the slightest deviation of lever 59 on compensating device 30" from an adjustable zero setting on transducer 63" results in negative or positive acceleration of roller 38 for recovering the said deviation. Before commencing actual production, machine 1 is subjected to a first setting operation for the purpose of producing cigarettes of a given length. This consists, firstly, in starting up, at a given constant speed, a cutting fixture (not shown) located downstream from table 5 and designed to cut rods 6 and 7 into cigarette lengths, after which, the speed of conveyor 35 is regulated by acting in known manner either on motor 69 or on the diameter of roller 37, so that, during the time interval between two consecutive strokes of the said cutting fixture, rod 6 is fed forward by the said given length.

During operation of machine 1, this setting operation must be repeated occasionally to compensate for changes in speed caused by wear gradually reducing the thickness on conveyor 35.

Testing has shown, however, that, despite continual fluctuation in the friction coefficient between conveyor 35 and strip 21, the length of the cigarettes produced from rod 6 remains for a long time within an acceptable tolerance range, with no need for any further adjustment. Compensating device 30' immediately adapts the speed of device 24 feeding strips 21 and 22 to the traveling speed of strip 21 along table 5 by keeping respective appendix 62 in a position corresponding to the zero setting on differential transducer 63'.

If compensating device 30'' and differential assembly 70 were not provided for, and rollers 37 and 38 were angularly integral, the length of the cigarettes produced from rod 7 would also vary for a relatively long period of time within the said acceptable tolerance range, but definitely not to the same extent as the cigarette lengths produced from rod 6. In fact, fluctuation in the friction coefficient between each of strips 21 and 22 and its respective conveyor is entirely unpredictable, and the wear on conveyors 35 and 36 is rarely the same on both. In other words, though acceptable, the length of the cigarettes produced from rods 6 and 7 would not be the same in both cases.

This problem is solved by compensating device 30'' which, via differential assembly 70 and conveyor 36, provides for continually adapting the travel of strip 22 to that of strip 21, in such a manner as to produce, for each stroke of the said cutting fixture (not shown), two cigarettes of exactly the same length from rods 6 and 7, and to prevent differing consumption of strips 21 and 22 from tearing the strips downstream from cutting fixture 17. Once the cigarette length has been set, machine 1 is subjected to a further setting operation for ensuring correct location on the resulting cigarettes of the graphics printed on the same by unit 16. This setting is made by adjusting plate 41 in relation to frame 2, so as to position strip 21 correctly in relation to the said cutting fixture, and then by adjusting timing device 23 in such a manner as to time the graphics on strip 22 to those on strip 21.

We claim:

1. Method of feeding strip paper on a dual-rod cigarette manufacturing machine (1), the said rods (6, 7) being formed by feeding, via respective conveying means (35, 36), a first and a second paper strip (21, 22) along a respective forming fixture (8) designed to fold each said strip (21, 22) crosswise about a respective layer of tobacco, the said strips (21, 22) being produced by cutting longitudinally in half a strip of paper (10) twice as wide as the said strips (21, 22); characterised by the fact that it comprises stages consisting in:

regulating a first (35) of the said conveyor means (35, 36) in such a manner as to feed the respective said first strip (21) at a given theoretical speed;

feeding the said strips (21, 22) to the respective conveying means (35, 36) by means of a feed device (24) common to both strips (21, 22);

controlling, via respective adjustable brake means (43), the tension of each of the said two strips (21, 22) extending between the said common feed device (24) and the respective said conveying means (35, 36), in such a manner as to maintain the tension of both said strips (21, 22) constantly equal to a given tension value;

controlling the said common feed device (24) in such a manner as to feed both the said strips (21, 22) at the same speed at which the said first strip (21) is actually fed by the said first conveying means (35);

controlling a second (36) of the said conveying means (35, 36) in such a manner as to feed the respective said second strip (22) at the same speed at which the said second strip (22) is fed by the said common feed device (24).

2. Method as claimed in claim 1, characterised by the fact that, for each said strip (21, 22), the said brake means comprise a suction shoe (43) engaged in sliding manner by said strip (21, 22); the tension of each said strip (21, 22) extending between the said common feed device (24) and the respective said conveying means (35, 36) being controlled by measuring, via detecting means (47, 48), the tension of the said strip portion (21, 22), and by controlling, via the said detecting means (47, 48), the power of a suction source (50) connected to the said shoe (43).

3. Method as claimed in claim 1, characterised by the fact that the said common feed device (24) is controlled by engaging, via first counterweight means (60), a portion of the said first strip (21) extending between the said common feed device (24) and the said first conveying means (35); by detecting the position of the said first counterweight means (60); and by acting on the said common feed device (24) in such a manner as to maintain the said first counterweight means (60) in a given position.

4. Method as claimed in claim 1, characterised by the fact that the traveling speed of the said second conveying means (36) is controlled by engaging, via second counterweight means (60), a portion of the said second strip (22) extending between the said common feed device (24) and the said second conveying means (36); by detecting the position of the said second counterweight means (60); and by acting on the said second conveing means (36) in such a manner as to maintain the said second counterweight means (60) in a given position.

5. Device for feeding strip paper on a dual-rod cigarette manufacturing machine (1), the said device comprising two fixtures (8) for simultaneously forming two continuous cigarette rods (6, 7), a common feed device (24) for supplying an identical first and second paper strip (21, 22) to the said fixtures (8) for respectively forming a said first and a said second continuous cigarette rod (6, 7), and first and second conveying means (35, 36) extending along the said forming fixtures (8) and designed to feed the said first and the said second rod (6, 7) respectively along the same; characterised by the fact that is also comprises first and second tension stabilizing means (31) and first and second compensating emans (30) cooperating respectively with the said first and the said second strip (21, 22); each said stabilizing means (31) comprising means (47, 48) for detecting the tension of the respective said strip (21, 22), and braking means (43) engaged in sliding manner by the said strip (21, 22) and the variable power of which is controlled by the respective said detecting means (47, 48) in such a manner as to maintain the said tension constantly equal to a given set tension; the said compensating means (30) comprising first and second counterweight means (60), supported respectively on the said first and second strips (21, 22), and first and second means (63) for respectively detecting the position of the said first and second counterweight means (60); the said first position detecting means (63) controlling the said common feed device (24) in such a manner as to maintain the said first counterweight means (60) in a given position, and the said second position detecting means (63) controlling the said second conveying means (36) in such a manner as to maintain the said second counterweight means (60) in a given position.

6. Device as claimed in claim 5, characterised by the fact that it also comprises a reel-off assembly (12) for winding a paper strip (10) off a reel (9), a cutting device (17) for cutting the said strip (10) longitudinally into the said two strips (21, 22), and third stabilizing means (18) cooperating with the said strip (10); the said third stabilizing means (18) comprising third means (46) for detecting the tension of the said strip (10), and third brake means (43) engaged in sliding manner by the said strip (10) and the variable power of which is controlled by the said third detecting means (46) in such a manner as to maintain the tension of the said strip (10) constantly equal to a given tension value.

7. Device as claimed in claim 5, characterised by the fact that each said brake means comprises a shoe (43), a chamber (49) inside the said shoe (43), a pierced surface (44) closing off the said chamber (49), and a variable-power suction source (50) connected to the said chamber (49); the said shoe (43) being mounted in such a manner as to turn about an axis parallel with the said pierced surface (44), and the respective said tension detecting means comprising means (46; 47, 48) for detecting the position of the said shoe (43), and controlling the power of the said suction source (50).

8. Device as claimed in claim 5, characterised by the fact that each said counterweight means comprises a lever (59) supported so as to turn about an axis perpendicular to the traveling direction of the respective strip (21, 22), and a roller (60) mounted in rotary manner on the free end of the said lever (59) and designed to engage the respective said strip (21, 22); the said first and the said second position detecting means (63) each detecting the angle of the respective said lever (59) about the respective said axis of rotation.

* * * * *